United States Patent [19]

Propst et al.

[11] 4,407,101

[45] Oct. 4, 1983

[54] BASE CONSTRUCTION FOR PANEL

[75] Inventors: Paul L. Propst, Holland; Donald A. Richardson, Kentwood; Carl B. Hinrichs, Grand Haven, all of Mich.

[73] Assignee: Stow/Davis Furniture Company, Grand Rapids, Mich.

[21] Appl. No.: 205,690

[22] Filed: Nov. 10, 1980

[51] Int. Cl.[3] ..... E04F 19/04; E04B 2/74

[52] U.S. Cl. ..... 52/126.3; 52/221; 52/242

[58] Field of Search ..... 52/122, 221, 242, 290, 52/126.1, 126.3, 126.4

[56] References Cited

U.S. PATENT DOCUMENTS

| | | | |
|---|---|---|---|
| 622,028 | 3/1899 | Welz . | |
| 2,169,274 | 8/1939 | Mills | 52/290 X |
| 3,066,770 | 12/1962 | Millard et al. | 52/242 X |
| 3,408,781 | 11/1968 | Pollock | 52/122 |
| 3,566,559 | 3/1971 | Dickson | 52/122 |
| 3,676,974 | 7/1972 | Daly | 52/221 X |
| 3,786,171 | 1/1974 | Shira | 174/48 X |
| 3,805,471 | 4/1974 | De Schutter | 52/122 X |
| 3,821,688 | 6/1974 | Larsile | 339/22 R |
| 4,037,380 | 7/1977 | Pollock | 52/122 X |
| 4,043,626 | 8/1977 | Propst et al. | 52/220 X |
| 4,086,734 | 5/1978 | Hayashi | 52/122 |
| 4,103,463 | 8/1978 | Dixon | 52/122 |
| 4,133,153 | 1/1979 | Hage | 52/242 |
| 4,158,936 | 6/1979 | Fulton | 52/242 |

*Primary Examiner*—Alfred C. Perham

*Attorney, Agent, or Firm*—Price, Heneveld, Huizenga & Cooper

[57] ABSTRACT

A wall panel support base for a wall panel support structure is disclosed having leveling apparatus, a floating seal, and a covered wire enclosure. The floating seal includes a floor seal engaging the floor and an outer seal slidably engaging the floor seal so that the outer seal engages the floor seal regardless of the adjustment of the leveling aparatus. The wire enclosure is located between the outer seal and the wall panel support structure and is covered by hinged covers extending between the outer seal and the wall panel support structure.

27 Claims, 4 Drawing Figures

BASE CONSTRUCTION FOR PANEL

BACKGROUND OF THE INVENTION

I. Field of the Invention

The present invention relates to a base construction for a wall panel assembly, and more specifically to a base construction having both (1) a seal between the wall panel support and the floor and (2) an accessible wire raceway contained therein.

II. Background of the Invention

Modular wall panels and furniture systems have recently gained widespread popularity due to their efficient and relatively inexpensive provision of office space. The modular construction provides a relatively high concentration of work stations within a given area.

As evidenced by the scope of the prior art, a need currently exists for a wall panel base construction which would both seal the wall panel against the floor and provide an easily accessible wire raceway so that electrical wiring could be run through the base.

One prior artisan has constructed a base support having a skirt so that as the wall panel support assembly is moved upwardly or downwardly relative to the base, the skirt hides some of the adjustable leg structure. This structure as shown in U.S. Pat. No. 3,566,559 has several drawbacks, however. First, the rigid foot members 138 are visible and a space between them and the bottom edge of skirt 130 can be seen through. As a result, there really is no seal between the panel and the floor. Second, no provision is made for accessing the space between guide walls 132 so that this could be used as an accessible wire raceway. Even if one were to install wires within this space, servicing the wires would be nearly impossible without taking the entire wall assembly apart. Furthermore, because the leveling mechanism is operated by turning the fastener, the adjustment cannot be accomplished while the panel construction is in place.

Oppositely threaded screw membes have long been used in the prior art as leveling devices. Examples include U.S. Pat. No. 3,805,471 and U.S. Pat. No. 622,028. However, access to such leveling mechanisms while the panel construction is in place is generally quite limited. No means of access at all is provided in U.S. Pat. No. 3,805,471 while U.S. Pat. No. 622,802 provides an access door on only one side of the leg limiting adjustment of the screw to one-quarter turn at a time. Consequently, adjustment of these prior art leveling screws is quite difficult.

Hinged covers concealing wire enclosures are also known in the prior art, although to may knowledge such covers have not previously been used on a wall panel support base. Examples of hinged covers on baseboard raceways are shown in U.S. Pat. Nos. 3,821,688; 3,786,171; and 3,676,974.

It is extremely important that provision be made in the wall panel assembly for running wiring, both electrical and telephone, through both the support base and the panel support assembly. This permits electrical outlets and telephone jacks to be located within each work station of the modular assembly. Furthermore, because the configuration of the modular assembly may be changed after its initial installation, any wiring should be easily accessible so that modifications can be made.

In recognition of the drawbacks and problems of the prior art, I have conceived that a wall panel support base should include both (1) a sealing construction for sealing the support structure against an uneven and/or unlevel floor and (2) an easily accessible wire enclosure through which both electrical lines and telephone wiring may be run. Furthermore, an easily accessible leveling mechanism should be included so that the wall panel assembly may be easily leveled after the entire structure has been assembled and is in place. The floor sealing means should eliminate any space which would allow one to see between the wall panel and the floor and also generally conform to the contour of the floor. The seal should be constructed of a sound-absorbing material so that one located in one work station will hear little of the noise produced at an adjacent work station. Furthermore, the floor seal should conform to even relatively rough or otherwise uneven floors.

The accessible wire enclosure should be accessible from any point along either side base. Furthermore, the adjusting means on the leveling mechanism should be easily accessible, possibly by locating same in the wire enclosure, so that leveling can be performed either before or after the modular system has been assembled.

SUMMARY OF THE INVENTION

The prior art drawbacks and problems are solved by the present invention in which a wall panel support base adapted to be mounted on a wall panel support structure has a plurality of feet, a floating seal to seal the wall panel support structure against the floor, and a wire enclosure constructed in conjunction with the floating seal so that both the wire and adjustment means for the floating seal is covered by hinged covers incorporated into the structure. In one aspect of the invention, the floating seal comprises a foam block engaging the floor between the feet and slidably mounted in a recess at the bottom of the panel construction with covers hingedly mounted over the wire enclosure and the adjustment means for the seal. In another aspect of the invention, a leveling apparatus including a screw member, externally threaded in opposite directions at its opposite ends, is mounted in the enclosure of the wall panel support structure whereby the adjustment for leveling the feet is accessible through the hinged covers.

The floating seal of the present invention eliminates all spaces between the support structure and the floor providing a visual seal therebetween. Furthermore, the seal provides an audible barrier between work areas adjacent either side of the support base. Finally, the foam block portion of the floating seal readily conforms to even a rough or otherwise uneven floor.

The covers which run the full length of the panels provide wide-open access to the wire enclosure contained within the floating seal. Consequently, installation and later modification of wiring within the modular assembly is easily accomplished through these access areas. Furthermore, because the leveling screws are located within this accessible wire enclosure, leveling of the modular structure may be performed after assembly and when the panel is in place.

These and other objects, advantages, and features of the invention will be more fully understood and appreciated by reference to the written specification and appended drawings.

DESCRIPTION OF THE PREFERRED EMBODIMENTS

Figure 1:
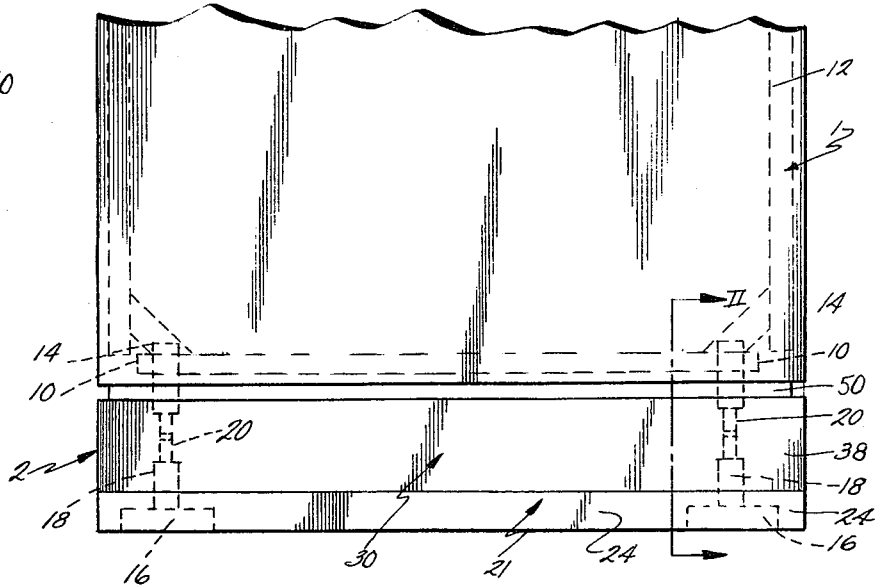
FIG. 1 is a fragmentary front plan view of the wall panel support base of the present invention with a support structure and wall panel installed thereon.
Figure 3:
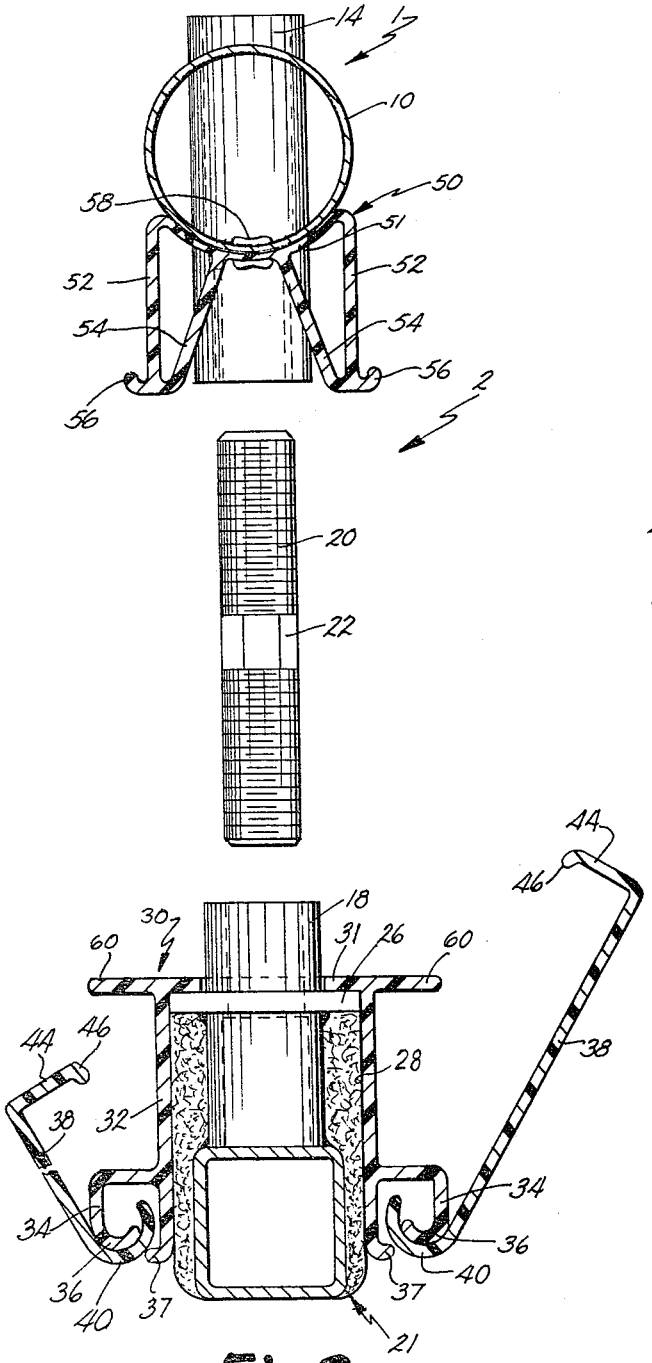
FIG. 3 is an exploded cross-sectional view of the support base along as shown in FIG. 2.
Figure 2:
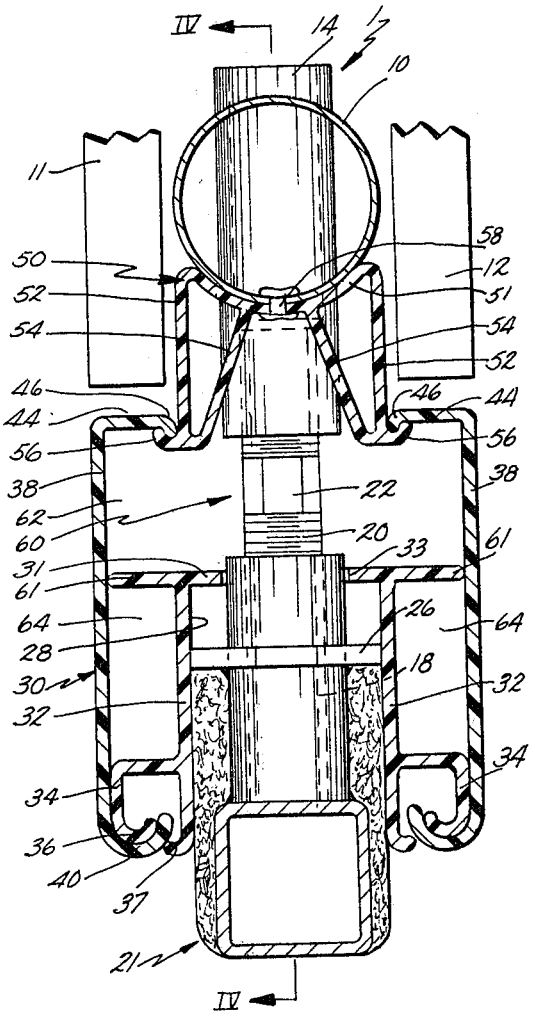
FIG. 2 is a cross-sectional view taken along II—II in FIG. 1.

As disclosed in FIGS. 1 and 2, the panel assembly of the present invention includes the tubular frame 1 on each side of which are mounted the panels 11 and 12. Frame 1 is made up of a plurality of horizontal and vertical tubes connected together as disclosed in our copending application Ser. No. 205,734, filed Nov. 10, 1980, entitled PANEL CONSTRUCTION SYSTEM WITH TUBULAR SUPPORT MEANS. FIG. 3 discloses one of the cylindrical tubes 10 mounted at the bottom of the frame 1 and to which the base structure 2 is attached. Panel support tube 10 (shown in all of the figures) is constructed of steel and is circular in cross section for optimum strength. Wall panels 11 and 12 are mounted on either side of panel support tube 10 so as to lie substantially adjacent the wall panel support assembly (not shown). This is most clearly shown in FIG. 2.

The base construction 2, comprising member 50, adjustment subassembly 60, foot subassembly 21, and the enclosure subassembly 30, is connected to and supports the frame 1 through the upper support member 50 and the adjustment subassembly 60 which includes upper insert 14, lower insert 18, and bolt 20 threaded at both ends into inserts 14 and 18, respectively.

Figure 4:
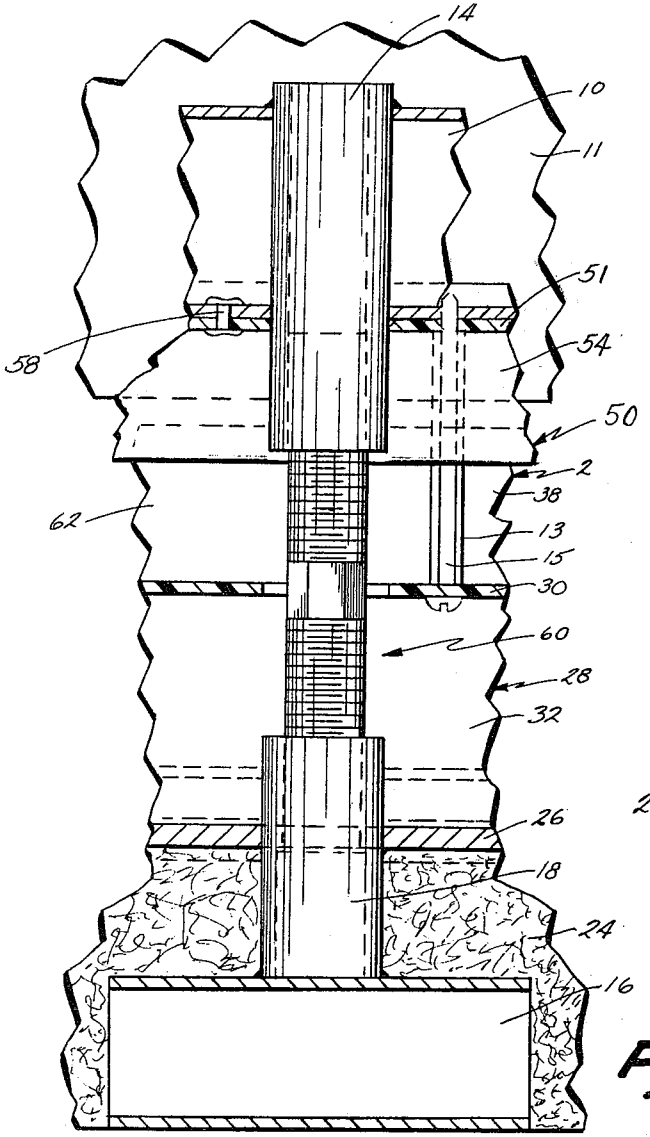
FIG. 4 is a cross-sectional view taken along IV—IV in FIG. 2.

Insert 14 is mounted within panel support tube 10 (as shown in FIGS. 3 and 4), preferably by welding, and insert 18 is mounted on top of each foot 16, preferably by welding. Both inserts are constructed of steel and have internally threaded diameters, the directions of threading being opposite.

Adjusting bolt 20 is an elongated cylindrical member having a hex portion 22 located approximately at the mid-portion thereof. It is externally threaded in opposite directions at its opposite ends so that same can be threaded into both upper and lower inserts 14 and 18. The spacing between panel support tube 10 and feet 16 may be adjusted by rotating adjusting bolt 20 with a wrench which engages hex portion 22. Thus, by turning adjusting bolt 20 in one direction, adjusting bolt 20 will cause inserts 14 and 18 to be separated thereby raising the panel support tube and the entire panel. By rotating adjusting bolt 20 in the opposite direction, upper and lower inserts 14 and 18 will be drawn toward each other thereby lowering panel support 10.

The foot assembly 21 comprises feet 16 and seal 24 which is an elongated member generally rectangular in cross section that encapsulates feet 16 and extends therebetween. A relatively soft material, such as a foam plastic, is used to fabricate floor seal 24 so that it may easily conform to a rough or uneven floor when pressed downwardly thereagainst. By encapsulating feet 16, floor seal 24 provides a continuous one-piece floor engaging member which is both functional and aesthetically pleasing. Floor seal 24 is functional because it prevents both light and sound from passing between the floor and the base support, and is aesthetically pleasing because it provides a one-piece floor contact member hiding feet 16 and making irregularities in the floor less noticeable. Retaining plate 26 is mounted, preferably by welding, upon and between lower cylinders 18 so as to exert downward pressure upon floor seal 24. This downward pressure aids in sealing floor seal 24 against the floor. Retaining plate 26 is constructed of steel and is generally the same length and width as floor seal 24.

The enclosure subassembly 30 is constructed of member 31 and covers 38 pivotally mounted on member 31. Member 31 is located below and maintained in spaced relationship to tube 10 by spacer 13 and screw 15. It is generally hat-shaped in cross section, having a recess 28 formed by substantially parallel sealing plate, or legs, 32 joined at their respective upper edges to member 31. Member 31 preferably is a plastic extrusion. The internal distance between legs 32 forming the recess 28 for receiving floor seal 24 is substantially the same as the width of floor seal 24 so that seal 24 may be slidably received therein. Member 31 includes the apertures 33 through which adjusting screws 20 extend.

When the floor seal 24 is operably received in the recess 28 of member 31, it may be slid between its lowermost position so that member 31 rests on retaining plate 26 (as shown in FIG. 3) or to its uppermost position (as shown in FIG. 4). Because legs 32 engage either side of floor seal 24, neither light nor sound can pass between these members. Hinge flanges 34 are generally L-shaped in cross section and extend outwardly and then downwardly from legs 32. U-shaped inner hinge portions 36 run along the terminal edge of hinge flanges 34 and extend inwardly and upwardly therefrom and are generally U-shaped in cross section. Hinge support ridges 37 extend outwardly and slightly upwardly from the lower edges of legs 32 so that hinge support ridges 37 extend generally towards inner hinge portions 36 but leaving a space therebetween.

Covers 38 are elongated and extend substantially the entire length of member 31. They may be fabricated either as a plastic extrusion or from roll-formed steel. The plastic material provides a relatively inexpensive cover, while the roll-formed steel, especially if chromed, has a classier look. The lower edge of covers 38 curves inwardly and then upwardly forming an upwardly opening outer hinge flange 40 which is generally U-shaped in cross section. Outer hinge flange 40 is inserted between inner hinge portion 36 and hinge support ridge 37 so that outer hinge flange 40 may pivot about inner hinge portion 36. Cover 38 may consequently pivot through a wide range from the fully upright position (shown in FIG. 2) downwardly past a horizontal position so that the upper edge of cover 38 contacts the floor. When pivoted fully downwardly, both wire enclosure 62 and side enclosures 64 are fully accessible. Cam flange 44 extends inwardly from covers 38 and terminates in a downwardly extended cam lock 46 running along the inside edge of cam flange 44.

Member 50 is a plastic extrusion and is substantially the same length as covers 38. It includes an elongated securing portion 51 which is generally arc-shaped in cross section and two generally parallel legs 52 extending downwardly from either edge of securing portion 51. Member 50 is secured to the underside of panel support tube 10 by fastening securing portion 51 to panel support tube 10 using rivets 58. Reinforcement members 54 are included to add increased rigidity to member 50. They extend from securing portion 51 to the lower edges of legs 52. Cam ridges 56 having generally arc-shaped cross sections extend outwardly and upwardly from the lower edges of legs 52. Cover 38 is closed in its upright position by pivoting same upwardly and snapping cam lock 46 behind cam ridge 56. Spacing flanges 61 comprise extensions on both sides of positioning plate 31 to engage and provide backing for covers 38 when tney are in fully upright or closed positions.

Because hex portion 22 is always located within wire enclosure 62, it is easily accessible by pivoting either of covers 38 downwardly. Wires, either electric or telephone, may be placed in any of the voids existing between closed covers 38. The preferable position for the wires is within wire enclosure 62 located directly above member 31. Alternatively, side enclosures 64 located between spacing flanges 60 and hinge flanges 34 may also be used. In any of these three locations, the wires and associated connections may be easily installed and accessed by merely rotating one or both of covers 38 downwardly to expose the enclosures. This facilitates both installation of the wiring and later modification if such becomes necessary.

Of course, it is understood that the above is merely a preferred embodiment of the invention and that various changes and alterations can be made without departing from the spirit and broader aspects of the invention as set forth in the appended claims, which are to be interpreted in accordance with the principles of patent law including the doctrine of equivalents.

The embodiments of the invention in which a property or privilege is claimed are defined as follows:

1. In a wall panel base constructin comprising:

a wall panel support means for supporting said wall panel;

foot means supporting said wall panel support means;

adjustment means variably spacing said support means above said foot means defining a void therebetween;

removable cover means for covering said void; and a floor seal means enveloping said foot means and extending the length of said wall panel base construction, said floor seal means engaging said floor and extending between said floor and said cover means over the spacing range of said adjustment means.

2. In a wall panel base construction comprising:

a wall panel support means for supporting said wall panel;

foot means supporting said wall panel support means;

adjustment means variably spacing said support means above said foot means defining a void therebetween;

removable cover means for covering said void; and a compressible floor seal means enveloping said foot means and extending the length of said wall panel base construction, said floor seal means engaging and generally conforming to said floor and extending between said floor and said cover means over the spacing range of said adjustment means.

3. The wall panel base of claims 1 or 2 in which an enclosure means is provided for housing wiring and the said adjustment means, said enclosure means including a lower member having a downwardly opening recess for receiving said foot means and seal means, said foot means and seal means being slidable within said recess and adjustable therein by means of said adjustment means, said cover means providing access to said adjustment means.

4. The wall panel base construction of claim 3 in which an upper member is provided; said upper member being secured to the support means; and said cover means being pivotally mounted on one of said upper or lower members and adapted to be removably secured to the other of said upper or lower members whereby the said cover means can be opened to provide access to the said adjustable means and any wiring within said enclosure means.

5. The wall panel base construction of claim 1 or 2 in which the adjustment means is a bolt having both ends threaded but in opposite directions, said bolt ends being received into threaded inserts correspondingly threaded, and means intermediate the ends for turning said bolt about its axis.

6. The wall panel base construction of claim 3 in which said lower member is hat shaped formed by downwardly extending legs between which is provided the said recess; said cover means having upper and lower edges; said lower ends of said legs having means for pivotally mounting the lower edges of said cover means; and said upper edges of said cover means in closed position.

7. The wall panel base construction of claim 1 or 2 wherein said floor seal means has first and second sides parallel to one another and wherein said base construction further comprises slidable sealing means comprising:

a member having first and second sealing plates extending therefrom, said first and second sealing plates being generally parallel to one another and generally perpendicular to said member and slidably engaging said first and second sides respectively; and mounting means mounting said cover on at least one of said first and second sealing plates.

8. The wall panel base construction of claim 1 or 2 in which the floor seal means is molded about at least portions of said foot means.

9. In a wall panel base construction comprising:

a wall panel support means for supporting said wall panel;

foot means supporting said wall panel support means;

adjustment means variably spacing said support means above said foot means defining a void therebetween;

a floor seal means engaging said foot means, said floor seal means engaging said floor;

removable cover means for covering said void;

an enclosure means for housing wiring and the said adjustment means, said enclosure means including a lower member having a downwardly opening recess for receiving said foot means and seal means, said foot means and seal means being slidable within said recess and adjustable therein by means of said adjustment means; and an upper member secured to the support means, said cover means being pivotally mounted on one of said upper or lower members and adapted to be removably secured to the other of said upper or lower members whereby the said cover means can be opened to provide access to the said adjustable means and any wiring within said enclosure means.

10. In a wall panel base construction comprising:

a wall panel support means for supporting said wall panel;

foot means supporting said wall panel support means;

adjustment means variably spacing said support means above said foot means defining a void therebetween;

a compressible floor seal means engaging said foot means, said floor seal means engaging and generally conforming to said floor;

removable cover means for covering said void;

an enclosure means for housing wiring and the said adjustment means, said enclosure means including a lower member having a downwardly opening recess for receiving said foot means and seal means, said foot means and seal means being slidable within said recess and adjustable therein by means of said adjustment means; and an upper member secured to the support means, said cover means being pivotally mounted on one of said upper or lower members and adapted to be removably secured to the other of said upper or lower members whereby the said cover means can be opened to provide access to the said adjustable means and any wiring within said enclosure means.

11. In a wall panel base construction comprising:

a wall panel support means for supporting said wall panel;

foot means supporting said wall panel support means;

adjustment means variably spacing said support means above said foot means defining a void therebetween;

a floor seal means engaging said foot means, said floor seal means engaging said floor;

removable cover means for covering said void; and an enclosure means for housing wiring and the said adjustment means, said enclosure means including a lower member having a downwardly opening recess for receiving said foot means and seal means, said foot means and seal means being slidable within said recess and adjustable therein by means of said adjustment means, said cover means providing access to said adjustment means, said lower member being hat shaped formed by downwardly extending legs between which is provided the said recess, said cover means having upper and lower edges, said lower ends of said legs having means for pivotally mounting the lower edges of said cover means, and said upper edges of said cover means includes means for detachably holding said cover means in closed position.

12. In a wall panel base construction comprising:

a wall panel support means for supporting said wall panel;

foot means supporting said wall panel support means;

adjustment means variably spacing said support means above said foot means defining a void therebetween;

a compressible floor seal means engaging said foot means, said floor seal means engaging and generally conforming to said floor;

removable cover means for covering said void; and an enclosure means for housing wiring and the said adjustment means, said enclosure means including a lower member having a downwardly opening recess for receiving said foot means and seal means, said foot means and seal means being slidable within said recess and adjustable therein by means of said adjustment means, said cover means providing access to said adjustment means, said lower member being hat shaped formed by downwardly extending legs between which is provided the said recess, said cover means having upper and lower edges, said lower ends of said legs having means for pivotally mounting the lower edges of said cover means, and said upper edges of said cover means includes means for detachably holding said cover means in closed position.

13. The construction of claim 11 or 12 in which the enclosure means includes an upper member spaced from said lower member; said upper edges of said cover means and said upper member having cooperating detent means for releasably holding the cover means in closed position.

14. In a wall panel base construction comprising:

a wall panel support means for supporting said wall panel;

foot means supporting said wall panel support means;

adjustment means variably spacing said support means above said foot means defining a void therebetween;

a floor seal means enveloping said foot means and extending the length of said wall panel base construction, said floor seal means engaging said floor;

removable cover means for covering said void;

enclosure means for housing wiring and said adjustment means, said enclosure means including a lower member having a downwardly opening recess for receiving said foot means and seal means, said foot means and seal means being slidable within said recess and adjustable therein by means of said adjustment means, said cover means providing access to said adjustment means; and an upper member secured to said support means, said cover means being pivotally mounted on one of said upper and lower members and adapted to be removably secured to the other of said upper and lower members whereby said cover means can be opened to provide access to said adjustment means and any wiring within said enclosure means.

15. In a wall panel base construction comprising:

a wall panel support means for supporting said wall panel;

foot means supporting said wall panel support means;

adjustment means variably spacing said support means above said foot means defining a void therebetween;

a compressible floor seal means enveloping said foot means and extending the length of said wall panel base construction, said floor seal means engaging and generally conforming to said floor;

removable cover means for covering said void;

enclosure means for housing wiring and said adjustment means, said enclosure means including a lower member having a downwardly opening recess for receiving said foot means and seal means, said foot means and seal means being slidable within said recess and adjustable therein by means of said adjustment means, said cover means providing access to said adjustment means; and an upper member secured to said support means, said cover means being pivotally mounted on one of said upper and lower members and adapted to be removably secured to the other of said upper and lower members whereby said cover means can be opened to provide access to said adjustment means and any wiring within said enclosure means.

16. In a wall panel base construction comprising:

a wall panel support means for supporting said wall panel;

foot means supporting said wall panel support means;

adjustment means variably spacing said support means above said foot means defining a void therebetween;

a floor seal means enveloping said foot means and extending the length of said wall panel base construction, said floor seal means engaging said floor;

removable cover means for covering said void; and enclosure means for housing wiring and said adjustment means, said enclosure means including a lower member having a downwardly opening recess for receiving said foot means and seal means, said foot means and seal means being slidable within said recess and adjustable therein by means of said adjustment means, said cover means providing access to said adjustment means; said lower member being hat shaped formed by downwardly extending legs between which is provided said recess, said cover means having upper and lower edges, said lower ends of said legs having means for pivotally mounting said lower edges of said cover means, said upper edges of said cover means including means for detachably holding said cover means in closed position.

17. In a wall panel base construction comprising:

a wall panel support means for supporting said wall panel;

foot means supporting said wall panel support means;

adjustment means variably spacing said support means above said foot means defining a void therebetween;

a compressible floor seal means enveloping said foot means and extending the length of said wall panel base construction, said floor seal means engaging and generally conforming to said floor;

removable cover means for covering said void; and enclosure means for housing wiring and said adjustment means, said enclosure means including a lower member having a downwardly opening recess for receiving said foot means and seal means, said foot means and seal means being slidable within said recess and adjustable therein by means of said adjustment means, said cover means providing access to said adjustment means; said lower member being hat shaped formed by downwardly extending legs between which is provided said recess, said cover means having upper and lower edges, said lower ends of said legs having means for pivotally mounting said lower edges of said cover means, said upper edges of said cover means including means for detachably holding said cover means in closed position.

18. The construction of claim 16 or 17 in which the enclosure means includes an upper member spaced from said lower member; said upper edges of said cover means and said upper member having cooperating detent means for releasably holding the cover means in closed position.

19. In a wall panel base construction comprising:

a wall panel support means for supporting said wall panel;

foot means supporting said wall panel support means;

adjustment means variably spacing said support means above said foot means defining a void therebetween;

a floor seal means enveloping said foot means and extending the length of said wall panel base construction, said floor seal means engaging said floor, said floor seal means including first and second sides parallel to one another;

slidable sealing means including a member having first and second sealing plates extending therefrom, said first and second sealing plates being generally parallel to one another and generally perpendicular to said member and slidably engaging said first and second sides respectively;

removable cover means for covering said void; and mounting means mounting said cover on at least one of said first and second sealing plates.

20. In a wall panel base construction comprising:

a wall panel support means for supporting said wall panel;

foot means supporting said wall panel support means;

adjustment means variably spacing said support means above said foot means defining a void therebetween;

a compressible floor seal means enveloping said foot means and extending the length of said wall panel base construction, said floor seal means engaging and generally conforming to said floor, said floor seal means including first and second sides parallel to one another;

slidable sealing means including a member having first and second sealing plates extending therefrom, said first and second sealing plates being generally parallel to one another and generally perpendicular to said member and slidably engaging said first and second sides respectively; removable cover means for covering said void; and mounting means mounting said cover on at least one of said first and second sealing plates.

21. The wall panel base construction of claim 19 or 20 further comprising a substantially rigid retaining plate secured to said foot means above said floor seal means, said retaining plate being secured to and pressing downwardly on said floor seal means thereby aiding said floor seal means in conforming to said floor.

22. The wall panel base construction of claim 21 wherein said mounting means comprises:

a generally L-shaped hinge flange extending outwardly and then downwardly from one of said sealing plates, said flange terminating in a hinge portion curving inwardly and then upwardly having a U-shaped cross section;

a hinge support ridge extending outwardly from a portion of said one sealing plate extending below said hinge flange; and an upwardly opening, U-shaped cover hinge flange running along said cover, said cover hinge flange positioned between said hinge flange and said hinge support ridge so that said cover hinge flange can pivot about said hinge flange.

23. The wall panel base construction of claim 22 wherein a snapping means is provided on said panel support means and on said cover means for removably retaining the cover in closed position comprising:

a cam ridge extending outwardly from said panel support means, said cam ridge having an upwardly turned terminal edge;

a cam flange extending inwardly from said cover; and a cam lock running along and extending downwardly from said cam flange, said cam ridge and said cam lock being positioned so that said cam lock snaps over and behind said cam ridge when said cover is in said closed position.

24. The wall panel base construction of claim 23 wherein said panel support means comprises:

a horizontal tubular support member;

an elongated securing member arc-shaped in cross section, opening upwardly, and fitted over a portion of said tubular securing member, said support member terminating in first and second arc edges and having first and second side plates extending downwardly from said first and second arc edges respectively, said first and second side plates being parallel to one another and of substantially the same height; and first and second reinforcement members extending from the arc-shaped portion of said securing member to the lower edges of said first and second side plates respectively.

25. The wall panel base construction of claim 24 wherein said variable spacing means comprises:

a generally vertical lower insert mounted on said foot means and internally threaded in a first direction;

a generally vertical insert mounted on said support means in general alignment with said lower insert and internally threaded in a second direction opposite to said first direction; and an adjusting bolt member having upper and lower ends externally threaded in directions whereby said lower end threadedly engages the threads of said lower insert and said upper end threadedly engages said upper insert.

26. The wall panel base construction of claim 25 further comprising means located between said upper and lower ends for gripping said adjusting bolt to permit rotation of same about its axis.

27. The wall panel base construction of claim 26 in which the floor seal means is molded about at least portions of said lower insert and foot means.

* * * * *

UNITED STATES PATENT AND TRADEMARK OFFICE

CERTIFICATE OF CORRECTION

PATENT NO. : 4,407,101

DATED : October 4, 1983

INVENTOR(S) : Paul L. Propst, Donald A. Richardson, & Carl B. Hinrichs

It is certified that error appears in the above-identified patent and that said Letters Patent is hereby corrected as shown below:

Column 1, line 40:
"membes" should be --members--;

Column 1, line 52:
"may" should be --my--;

Column 3, line 4:
"along" should be --alone--;

Column 5, line 27:
"constructin" should be --construction--;

Column 6, line 17:
after "cover means" insert --includes means for detachably holding said cover means--;

Signed and Sealed this

Second Day of October 1984

[SEAL]

*Attest:*

*Attesting Officer*

GERALD J. MOSSINGHOFF

*Commissioner of Patents and Trademarks*